US006901990B2

(12) United States Patent
Howard et al.

(10) Patent No.: US 6,901,990 B2
(45) Date of Patent: Jun. 7, 2005

(54) METHOD AND SYSTEM FOR PROCESSING CASTINGS

(75) Inventors: Robert Howard, Marietta, GA (US); Paul M. Crafton, Kennesaw, GA (US); Scott P. Crafton, Marietta, GA (US); James L. Lewis, Jr., Kennesaw, GA (US); Volker R. Knobloch, Woodstock, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

(21) Appl. No.: 10/621,639

(22) Filed: Jul. 17, 2003

(65) Prior Publication Data

US 2004/0108092 A1 Jun. 10, 2004

Related U.S. Application Data

(60) Provisional application No. 60/397,177, filed on Jul. 18, 2002.

(51) Int. Cl.[7] ..... B22D 29/00

(52) U.S. Cl. ..... 164/76.1; 164/5; 164/132; 266/44; 266/262; 266/252; 266/254

(58) Field of Search ..... 164/76.1, 5, 132; 266/44, 262, 252, 253

(56) References Cited

U.S. PATENT DOCUMENTS

| | | | | |
|---|---|---|---|---|
| 2,385,962 A | 10/1945 | Barnett | 34/13 |
| 2,813,318 A | 11/1957 | Horth | 22/89 |
| 2,988,351 A | 6/1961 | Barnett et al. | 263/40 |
| 3,194,545 A | 7/1965 | Smith | 266/3 |
| 3,222,227 A | 12/1965 | Baugh et al. | 148/11.5 |
| 3,432,368 A | 3/1969 | Nakamura | 148/12 |
| 3,534,946 A | 10/1970 | Westerkamp et al. | 263/28 |
| 3,604,695 A | 9/1971 | Steeper | 266/5 T |
| 3,675,905 A | 7/1972 | Placek | 263/2 |
| 3,737,280 A | 6/1973 | Cromp | 432/14 |
| 3,760,800 A | 9/1973 | Staffin et al. | 128/24.1 |
| 3,794,232 A | 2/1974 | Petri | 226/50 |
| 3,856,583 A | 12/1974 | Sanders et al | 148/159 |
| 3,871,438 A | 3/1975 | Vissers et al. | 164/5 |
| 3,996,412 A | 12/1976 | Schaefer et al. | 13/20 |
| 4,021,272 A | 5/1977 | Asai et al. | 148/15 |
| 4,027,862 A | 6/1977 | Schaefer et al. | 266/160 |
| 4,068,389 A | 1/1978 | Staffin et al. | 34/57 A |
| 4,098,624 A | 7/1978 | Laird, Jr. | 148/153 |
| 4,111,158 A | 9/1978 | Reh et al. | 122/4 D |

(Continued)

FOREIGN PATENT DOCUMENTS

| | | | |
|---|---|---|---|
| CA | 1197981 | 12/1985 | 38/18 |
| DE | 553653 | 6/1932 | B22D/31/15 |

(Continued)

OTHER PUBLICATIONS

"Mehrzweck–Schachtofen–Automat mit gasdichter beheizter Umsetzvorrichtung", Haerterei Technische Mitteilungen., vol. 42, No. 3, 1987, pp. 169–173, XP002265361, Carl Hanser Verlag, Munchen, German, ISSN: 0341–101X.

(Continued)

*Primary Examiner*—Kiley S. Stoner
*Assistant Examiner*—I.-H. Lin
(74) *Attorney, Agent, or Firm*—Womble Carlyle Sandridge & Rice, PLLC.

(57) ABSTRACT

A method and system of processing castings is provided in which one or more castings are deposited into a mobile furnace and moved from one station to another of a multi-station casting processing system. The interior of the mobile furnace is heated so as to maintain the temperature of the casting within a desired range of temperatures. The multi-station casting processing system may include a casting machine, a fluidized bed and a quench tank. The method may include transferring a casting into the mobile furnace and moving the furnace from one station to another.

44 Claims, 2 Drawing Sheets

U.S. PATENT DOCUMENTS

| | | | | | |
|---|---|---|---|---|---|
| 4,140,467 | A | | 2/1979 | Ellison et al. | 432/72 |
| 4,161,389 | A | | 7/1979 | Staffin et al. | 432/58 |
| 4,177,085 | A | | 12/1979 | Chadwick et al. | 148/2 |
| 4,177,952 | A | | 12/1979 | Rikker | 241/40 |
| 4,198,764 | A | | 4/1980 | Ellison et al. | 34/32 |
| 4,206,553 | A | | 6/1980 | Ellison et al. | 34/28 |
| 4,211,274 | A | | 7/1980 | Slowinski et al. | 164/401 |
| 4,242,077 | A | | 12/1980 | Hyre | 431/19 |
| 4,255,133 | A | | 3/1981 | Tanifuji et al. | 432/24 |
| 4,257,767 | A | | 3/1981 | Price | 432/24 |
| 4,294,436 | A | | 10/1981 | Takahashi | 266/257 |
| 4,325,424 | A | | 4/1982 | Scheffer | 164/5 |
| 4,338,077 | A | | 7/1982 | Shibayama et al. | 432/11 |
| 4,340,433 | A | | 7/1982 | Harding | 148/16 |
| 4,357,135 | A | | 11/1982 | Wilde et al. | 432/11 |
| 4,392,814 | A | | 7/1983 | Harding | 431/170 |
| 4,411,709 | A | | 10/1983 | Nakanishi | 148/3 |
| 4,415,444 | A | | 11/1983 | Guptail | 209/3 |
| 4,419,143 | A | | 12/1983 | Ito et al. | 148/3 |
| 4,420,345 | A | | 12/1983 | Ito et al. | 148/3 |
| 4,457,352 | A | | 7/1984 | Scheffer | 164/5 |
| 4,457,788 | A | | 7/1984 | Staffin et al. | 148/20.3 |
| 4,457,789 | A | | 7/1984 | Wilks | 148/134 |
| 4,478,572 | A | | 10/1984 | Selli | 432/13 |
| 4,490,107 | A | | 12/1984 | Kimura et al. | 422/11 |
| 4,499,940 | A | | 2/1985 | Hall | 164/36 |
| 4,512,821 | A | | 4/1985 | Staffin et al. | 148/16.5 |
| 4,519,718 | A | | 5/1985 | Staffin et al. | 374/45 |
| 4,524,957 | A | | 6/1985 | Staffin et al. | 266/252 |
| 4,544,013 | A | | 10/1985 | Kearney et al. | 164/5 |
| 4,547,228 | A | | 10/1985 | Girrell et al. | 148/16 |
| 4,577,671 | A | | 3/1986 | Stephan | 164/401 |
| 4,579,319 | A | | 4/1986 | Sasaki | 266/252 |
| 4,582,301 | A | | 4/1986 | Wunning | 266/87 |
| 4,604,055 | A | | 8/1986 | Mackenzie | 432/58 |
| 4,606,529 | A | | 8/1986 | Tooch | 266/80 |
| 4,613,713 | A | | 9/1986 | Staffin et al. | 585/241 |
| 4,620,586 | A | | 11/1986 | Musschoot | 164/253 |
| 4,620,884 | A | | 11/1986 | Heath | 148/128 |
| 4,623,400 | A | | 11/1986 | Japka et al. | 148/6.35 |
| 4,648,836 | A | | 3/1987 | Thom | 432/107 |
| 4,671,496 | A | | 6/1987 | Girrell et al. | 266/78 |
| 4,681,267 | A | | 7/1987 | Leidel et al. | 241/23 |
| 4,700,766 | A | | 10/1987 | Godderidge | 164/5 |
| 4,752,061 | A | | 6/1988 | Dalton et al. | 266/87 |
| 4,779,163 | A | | 10/1988 | Bickford et al. | 361/212 |
| 4,804,032 | A | | 2/1989 | Wilkins | 164/34 |
| 4,817,920 | A | | 4/1989 | Erfort, Jr. | 266/252 |
| 4,830,605 | A | | 5/1989 | Hodate et al. | 431/170 |
| 4,832,764 | A | | 5/1989 | Merz | 148/131 |
| 4,878,952 | A | | 11/1989 | Pillhoefer | 148/1 |
| 4,955,425 | A | | 9/1990 | McKenna | 164/269 |
| 5,018,707 | A | | 5/1991 | Hemsath et al. | 266/254 |
| 5,108,519 | A | | 4/1992 | Armanie et al. | 148/12.7 A |
| 5,108,520 | A | | 4/1992 | Liu et al. | 148/12.7 R |
| 5,115,770 | A | | 5/1992 | Yen et al. | 123/193.6 |
| 5,120,372 | A | | 6/1992 | Yen et al. | 420/537 |
| 5,156,800 | A | | 10/1992 | Buchet et al. | 266/99 |
| 5,169,913 | A | | 12/1992 | Staffin et al. | 526/65 |
| 5,178,695 | A | | 1/1993 | LaSalle et al. | 148/698 |
| 5,226,983 | A | | 7/1993 | Skinner et al. | 148/549 |
| 5,251,683 | A | | 10/1993 | Backer | 164/98 |
| 5,253,698 | A | | 10/1993 | Keough et al. | 164/269 |
| 5,265,851 | A | * | 11/1993 | Beuret et al. | 266/262 |
| 5,294,094 | A | * | 3/1994 | Crafton et al. | 266/44 |
| 5,306,359 | A | | 4/1994 | Eppeland et al. | 148/511 |
| 5,308,410 | A | | 5/1994 | Horimura et al. | 148/561 |
| 5,312,498 | A | | 5/1994 | Anderson | 148/695 |
| 5,336,344 | A | | 8/1994 | Wei | 148/549 |
| 5,340,089 | A | | 8/1994 | Heath et al. | 266/87 |
| 5,340,418 | A | | 8/1994 | Wei | 148/549 |
| 5,350,160 | A | | 9/1994 | Crafton et al. | 266/252 |
| 5,354,038 | A | | 10/1994 | Crafton | 266/44 |
| 5,378,434 | A | | 1/1995 | Staffin et al. | 422/141 |
| 5,416,967 | A | * | 5/1995 | Cress | 29/436 |
| 5,423,370 | A | | 6/1995 | Bonnemersou et al. | 164/132 |
| 5,439,045 | A | | 8/1995 | Crafton | 164/5 |
| 5,477,906 | A | | 12/1995 | Legge et al. | 164/122.1 |
| 5,485,985 | A | | 1/1996 | Eppeland et al. | 266/87 |
| 5,514,228 | A | | 5/1996 | Wyatt-Mair et al. | 148/551 |
| 5,518,557 | A | | 5/1996 | Jones et al. | 148/511 |
| 5,531,423 | A | | 7/1996 | Crafton et al. | 266/44 |
| 5,536,337 | A | | 7/1996 | Wei | 148/549 |
| 5,547,523 | A | | 8/1996 | Blankenship, Jr. et al. | 148/677 |
| 5,551,670 | A | | 9/1996 | Heath et al. | 266/87 |
| 5,551,998 | A | | 9/1996 | Crafton et al. | 148/538 |
| 5,565,046 | A | | 10/1996 | Crafton et al. | 148/538 |
| 5,571,347 | A | | 11/1996 | Bergsma | 148/550 |
| 5,593,519 | A | | 1/1997 | Blankenship, Jr. et al. | 148/514 |
| 5,643,372 | A | | 7/1997 | Sainfort et al. | 148/699 |
| 5,735,334 | A | | 4/1998 | Sutton et al. | 164/130 |
| 5,738,162 | A | | 4/1998 | Crafton | 164/5 |
| 5,829,509 | A | | 11/1998 | Crafton | 164/5 |
| 5,850,866 | A | | 12/1998 | Crafton | 164/5 |
| 5,957,188 | A | | 9/1999 | Crafton | 164/5 |
| 6,093,367 | A | * | 7/2000 | Barboni et al. | 266/252 |
| 6,112,803 | A | | 9/2000 | Kruger | 164/103 |
| 6,217,317 | B1 | | 4/2001 | Crafton et al. | 432/128 |
| 6,336,809 | B1 | | 1/2002 | Crafton et al. | 432/207 |
| 6,547,556 | B2 | | 4/2003 | Crafton et al. | 432/124 |
| 6,725,903 | B2 | * | 4/2004 | Laurino | 164/323 |

FOREIGN PATENT DOCUMENTS

| | | | |
|---|---|---|---|
| DE | 1030974 | 5/1958 | B22D/31/32 |
| DE | 2307773 | 2/1973 | |
| DE | 2323805 | 5/1973 | |
| DE | 2310541 | 9/1973 | C21D/1/00 |
| DE | 2315958 | 4/1974 | B08B/5/00 |
| DE | 2337894 | 11/1974 | B08B/7/04 |
| DE | 2914221 | 4/1979 | |
| DE | 3206048 | 2/1982 | |
| DE | 3215809 | 11/1983 | B22D/29/00 |
| DE | 4012158 | 11/1990 | 164/5 |
| DE | 195 30 975 | 2/1997 | B22C/5/00 |
| EP | 0 077 511 | 10/1982 | B22D/29/00 |
| EP | 0546210 A1 | 6/1993 | B22D/29/00 |
| EP | 0 610 028 | 8/1994 | F27D/3/00 |
| EP | 0785402 A1 | 7/1997 | F27D/3/00 |
| EP | 0893510 A1 | 1/1999 | C21D/9/00 |
| EP | 1229137 A1 | 8/2002 | C21D/9/00 |
| FR | 255 008 | 3/1961 | |
| FR | 2 448 573 | 3/1961 | C21D/9/00 |
| FR | 7043571 | 12/1970 | G01N/15/00 |
| FR | 2448573 | 2/1979 | C21D/9/00 |
| GB | 1392405 | 4/1975 | G01N/25/00 |
| GB | 1564151 | 4/1980 | |
| GB | 1569152 | 6/1980 | |
| GB | 2137114 | 10/1984 | B01J/8/26 |
| GB | 2187398 | 9/1987 | F27B/15/09 |
| GB | 2230720 | 10/1990 | B22D/29/00 |
| GB | 2248569 | 4/1992 | B22D/29/00 |
| JP | 5653867 | 5/1981 | |
| JP | 5939464 | 8/1982 | |
| JP | 5825417 | 2/1983 | C21D/1/00 |
| JP | 5825860 | 2/1983 | |
| JP | 59078764 | 7/1984 | B22D/13/00 |
| JP | 59219410 | 12/1984 | |
| JP | 6092040 | 5/1985 | 164/132 |
| JP | 2074022 | 9/1985 | |
| JP | 61007058 | 1/1986 | B22D/29/00 |
| JP | 61067540 | 7/1986 | B22C/9/02 |

| | | | |
|---|---|---|---|
| JP | 62110248 | 5/1987 | |
| JP | 6316853 | 1/1988 | ..... 164/132 |
| JP | 63108941 | 5/1988 | |
| JP | 1-91957 | 4/1989 | |
| JP | 1-122658 | 5/1989 | ..... B22D/29/00 |
| JP | 2104164 | 8/1990 | |
| JP | 3-465 | 1/1991 | ..... B22D/29/00 |
| SU | 1129012 | 7/1982 | |
| SU | 0234810 | 3/1985 | ..... 164/132 |
| WO | WO 97/30805 | 8/1997 | |
| WO | WO 98/14291 | 4/1998 | |
| WO | WO 99/07903 | 2/1999 | ..... C21D/9/00 |
| WO | WO 00/36354 | 6/2000 | ..... F27B/5/04 |
| WO | WO 01/08836 | 2/2001 | ..... B22D/29/00 |
| WO | WO 02/063051 | 8/2002 | ..... B22D/29/00 |
| WO | WO 02/094479 | 11/2003 | ..... B22D/29/00 |

OTHER PUBLICATIONS

Economical Used Energy Type Continuing Heat Treating Furnace For Aluminum Castings Dogyo—Kanetsu vol. 21 No. 2 pp. 29–36—Mar. 1984.

Brochures describing Beardsley & Pipe PNEU–RECLAIM Sand Reclamation Units Prior to Aug. 13, 1992.

Brochure describing Fataluminum Sand Reclamation Units—Prior to Aug. 13, 1992.

Paul M. Crafton—Heat Treating Aging System Also Permits Core Sand Removal—Reprinted from Sep. 1989 Modern Castings magazine.

Sales brochure describing Thermfire Brand Sand Reclamation, Gudgeon Bros., Ltd. believed to be known to others prior to Sep. 1989.

Sales brochure describing Simplicity/Richards Gas–Fired Thermal Reclamation System Simplicity Engineering, Inc.—believed to be known to others prior to Sep. 1989.

Sales brochure describing AirTrac Brand Fluidizing Conveyor, Air Trac Systems Corp., believed to be known to others prior to Sep. 1989.

Sales brochure describing Fluid Bed Calcifer Thermal Sand Reclamation Systems, Dependable Foundry Equipment Co.—Believed to be known to others prior to Sep. 1989.

Foundry Management & Technology—Dec. 1989—vol. 117; No. 12; p. G3—Shakeout/Cleaning/Finishing Brochure.

Aluminum Solution Heat Treating Equipment—CEC—Brochure 1993 Sand Lion Systems—CEC—Brochure 1993.

* cited by examiner

METHOD AND SYSTEM FOR PROCESSING CASTINGS

CROSS-REFERENCE TO RELATED APPLICATIONS

This application claims priority to U.S. Provisional Application Ser. No. 60/397,177, filed Jul. 18, 2002.

TECHNICAL FIELD

The present invention generally relates to the manufacturing of metal castings and more particularly to heat treating metal castings during the manufacturing process.

BACKGROUND

Traditional casting processes for forming metal castings generally include one or more heat processing steps to impart the desired performance characteristics to the castings. These heat processing steps usually are conducted in separate furnaces or stations. A casting must be transported from one station to another in order to be processed. Generally, either the various stations are disposed in an enclosed system or are arranged in proximity to each other in an open system. Enclosed systems include fixed closed passageways between processing stations and tend to take up a significant amount of space and cannot be reconfigured easily. Open systems generally do not include fixed closed passageways between process stations. Although open systems generally allow more flexibility and take up less space than open systems, unfortunately, a casting will usually lose heat and drop in temperature during transport between stations in an open system. Since many processing steps in manufacturing a metal casting require that the casting be within a specified temperature range for heat treatment, if the casting temperature drops out of the specified range during transport, then additional heat must be supplied to the casting in the next station simply to bring the casting temperature back into the appropriate range. This remedial heating takes time that lowers the efficiency and productivity of the overall system.

Consequently, a need exists for a casting system that can provide the advantages of an open system but also reduces or eliminates any drop in the temperature of castings that are transported between processing stations.

SUMMARY

The present invention comprises a method and a system for supplying heat to a casting as it is transported from one station to another during processing. According to one embodiment of the present invention, a method of processing a casting is provided in which a casting is transferred into a furnace; the furnace is moved; and, the casting is transferred from the furnace to a processing station. Heat is supplied to the casting within the furnace by any one or more of radiant, conductive or convective heat transfer mechanisms. The method can include molding, heat treating, quenching, and holding steps. For example, the casting can be formed by pouring a molten metal material into a mold at a casting station. Heat treatment of the casting can be carried out again by exposing the casting to radiant, conductive or convective heat. In one embodiment, heat treatment can be carried out by exposing the casting to a fluidized bed within one the processing stations.

In another embodiment, the method of processing a casting comprises transferring a casting into a furnace; moving the furnace to a first position; transferring the casting from the furnace to a processing station; processing the casting within the processing station; returning the casting from the processing station back to the furnace; moving the furnace to a second position; and, removing the casting from the furnace. In this manner, a casting can be formed, heat treated, quenched and otherwise processed while maintaining the temperature of the casting within a desired range by applying heat to the casting while it is in the furnace.

The present invention also encompasses a casting system for processing castings. The casting system includes a mobile furnace and a multi-station processing array with first and second stations between which the mobile furnace moves. The mobile furnace contains a heating element for supplying heat to one or more castings disposed within the furnace. The mobile furnace moves between the first and second stations of the multi-station processing array so as to transfer castings from one processing station to the next. A casting can be deposited in the mobile furnace and be maintained within a predetermined temperature range as it is transferred from one station to another. A transfer mechanism also is provided that transfers one or more castings between the mobile furnace and the processing stations. The multi-station processing array can include a variety of stations, such as, for example, a casting station, one or more heat treating stations, quenching stations, and holding stations. The heat treating stations can include assemblies that supply radiant, conductive or convective heat to the casting. In one embodiment, the multi-station system includes a multi-chambered fluidized bed into which a casting can be deposited from the mobile furnace for heat treatment. A casting can be moved from one chamber to another of the fluidized bed by first transferring it into the mobile furnace, moving the furnace into position adjacent the next chamber and transferring the casting into the next chamber from the mobile furnace.

In another embodiment, the casting system includes at least one heat treatment station and a furnace, such as a drop bottom furnace, that is movable between the heat treatment station and at least one other station of the casting system. The furnace can be moved into position above the heat treatment station so as to transfer one or more castings between the furnace and the station. A transfer mechanism can be used to move the casting from the mobile furnace to the heat treatment station and back again after heat treatment. The transfer mechanism can be operably connected to the furnace so as to raise and lower castings between the furnace and the heat treatment station. One or more removable lids also can be included in the casting system. Each lid can include a casting support for supporting one or more castings and a catch for engagement with the transfer mechanism. The removable lid having one or more castings supported thereon can be raised by the transfer mechanism into the furnace. The furnace then can be moved, with both casting(s) and lid disposed therein, over the heat treatment station. The transfer mechanism can then be activated to lower the lid and casting(s) down to the station so to deposit the castings in the station and close the station with the lid. The castings can be heat treated and then removed, along with the lid, and transferred back into the furnace, which can then be moved to the next position.

These and other aspects of the present invention will become apparent to those skilled in the art upon reading the following detailed description, when taken in conjunction with the accompanying drawings, which are briefly described as follows.

DETAILED DESCRIPTION

Figure 1:
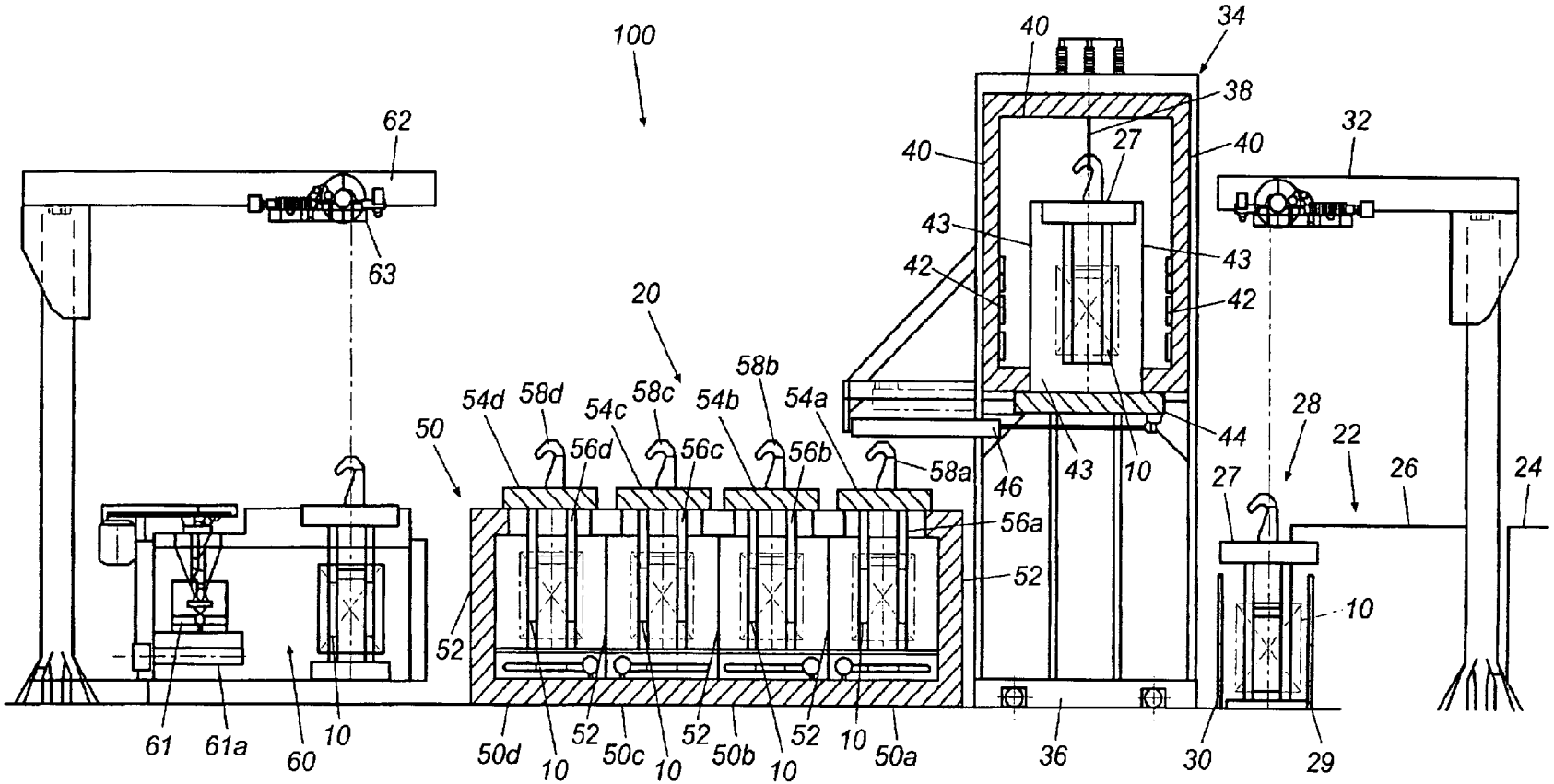
FIG. 1 is a side elevation view of the casting system of the present invention with portions of the system removed and other portions of the system shown in cross-section.

The present invention generally comprises a method and apparatus for processing a casting and transporting the casting in a furnace between processing stations. The casting can be transferred into the furnace containing a heated interior in which the temperature of a casting can be maintained at or above a specified temperature or within a predetermined temperature range, or the casting can be quenched. The furnace is movable between two or more positions that allow for the efficient transfer of the casting between processing chambers or stations. After processing in a particular station, the casting can be returned to the same furnace or moved into another mobile furnace for transport to the next station. A casting can be molded, heat treated, quenched or otherwise processed by the method and within the system of the present invention. The method and system of the present invention can be incorporated into either an open system with no enclosed passageway between systems or closed systems including such a passageway between at least two of the stations. The processing stations included in the method and system of the present invention may include enclosed structures separated from the remainder of the system or structures that are open to other portions of the system. U.S. Provisional Application Serial No. 60/397,177, filed Jul. 18, 2002 is hereby incorporated by reference in its entirety.

As used herein, the term "furnace" refers to any structure that is at least partially enclosed and has a dedicated supply of heat to an interior portion thereof. The heat supply to the interior portion of the furnace can include radiant, conductive, convective heat or a combination thereof. The dedicated heat can be generated in or at the furnace or can be supply from a remote location. However, the heat supply generally is not heat that simply enters the interior of the furnace from the atmosphere immediately surrounding the furnace. Although the embodiment set forth below is described in terms of a mobile drop bottom furnace, other types of furnaces can be used according to the method and within the system of the present invention. For example, the mobile furnace can be an atmosphere furnace, a box furnace, a bell furnace, a car bottom furnace, a cover lift car bottom furnace, a pit furnace, a tip-up furnace, a roller hearth furnace, a retort, a conveyor furnace or other types of batch-type or continuous-type furnaces.

As used herein, the term "processing station" encompasses any locale or combination of positions where a casting is processed to alter its characteristics. Examples of various processes that may be carried out in a processing station include, but are not limited to, aging, annealing, austempering, baking, blasting, brazing, bright annealing, carbonitriding, carbon baking, carbon restoration, carburizing, coating, cooling, core removal, curing, forming, forge relief, hardening, heating, homogenizing, molding, nitriding, painting, quenching, sand/core removal, spherodizing, solution heat treating, stress-relief, tempering, and washing.

Figure 2:
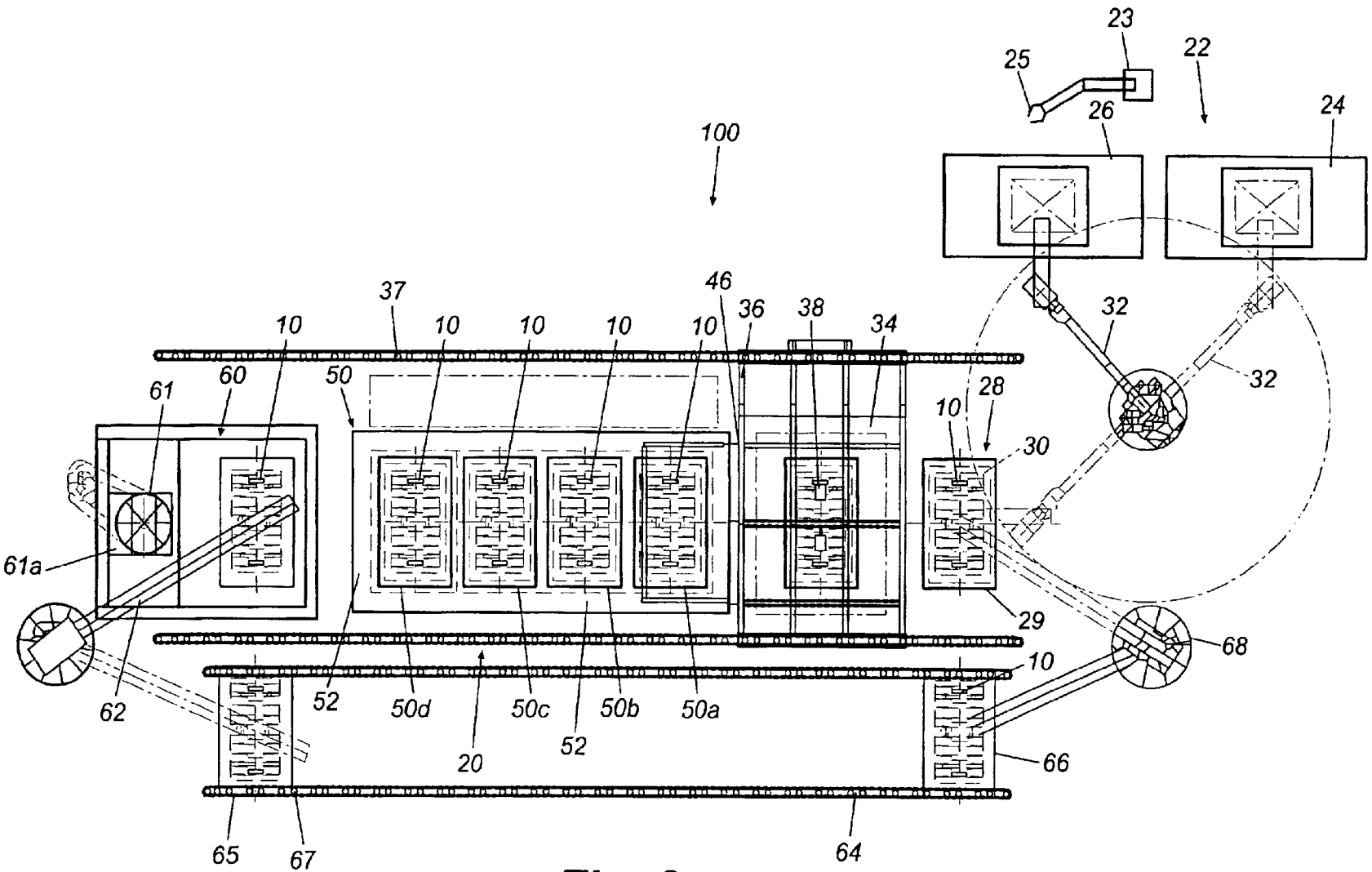
FIG. 2 is a top view of the casting system of FIG. 1 embodying principles of the present invention.

One embodiment of the system for supplying heat to a casting is set forth in FIGS. 1 and 2. The system 100 includes a multi-station casting processing system 20 in combination with a mobile furnace 34. Generally, a casting 10 is processed in the system 100 by disposing the casting in the furnace 34 and transferring the casting 10 and the mobile furnace 34 from one station of the multi-station casting processing system 20 to another. Exemplary castings can be used in bus transmissions as an oil transfer plats. Conventional casting processes for this type of casting require approximately a nine hour bake-out to remove the core sand from the casting. Alternatively, the method and system of the present invention can accomplish this task in some cases in about 45 minutes. An example of a casting is formed from A-356 alloy and is approximately 31 inches long 24 inches wide 5 inches deep. The casting can include approximately 80 lbs of aluminum and 42 lbs of sand after it has been formed and removed from the mold. However, castings processed according to the method and with the system of the present invention may be formed of alternative alloys and metals and may have dimensions and weights that vary from the example.

As shown in the figures, the multi-station casting processing system 20 may include a casting machine 22 and one or more heat treatment stations, such as, for example, fluidized bed 50. While the multi-station casting processing system 20 is shown in the figures with the casting machine 22 and the fluidized bed 50, other configurations are contemplated for the system of the present invention. For example, the multi-station casting processing system may not include a casting machine, or instead of a fluidized bed 50, the multi-station casting processing system 20 may include one or more convective furnaces or heating stations, other types of conductive or radiative heating stations, cooling stations or other processing stations.

The casting machine 22 can include one or more tilt/pour stations 24 and 26. In one embodiment, the tilt/pour station 24 is approximately 4 feet by 8 feet. The casting mold used to form the castings in the casting machine 22 may be a permanent mold that is used in combination with cores formed with sand and binder. The casting 10 can be formed in one of the tilt/pour stations 24 and 26 by pouring a molten metal into the mold containing the core and allowing the casting to at least partially solidify in the mold. The casting can then be removed from the mold utilizing a retractor 23. The retractor 23 may have at least three axes (in-out, rotate at the wrist, rotate about the in/out axis). It also may have a release type gripper 25 and thermal insulation for protecting the mechanism from the heat of the casting. In one embodiment, about seven castings per hour can be formed in each of the tilt/pour stations 24 and 26, leading to a total of about fourteen castings per hour produced with two station casting machine. The casting 10 can then be moved from one of the first and second tilt/pour stations 24 and 26 using the retractor 23 and rotated for insertion into a heat treat rack or casting support 27. The casting support 27 can include a series of brackets, shelves, hooks or similar means for mounting one or more castings thereon.

The casting support 27 can then be moved to a loading station 28 using a casting loader or gantry 32. The loading station 28 may include a thermal arrest unit 29 that can either maintain or increase the temperature of the casting 10 in order to facilitate further processing thereof. The casting 10 can be held in the thermal arrest unit 29 as additional castings are added thereto until an appropriate number of castings 10 are assembled at the loading station 28 for further processing. In one embodiment, castings 10 are accumulated with a dwell of about thirteen minutes between the first and the last castings in the group, although alternative times also are encompassed.

The thermal arrest unit 29 includes one or more radiating panels 32 that supply heat to the casting 10. As indicated previously, one or more castings may be positioned on the casting support 27. Consequently, a plurality of castings can be transferred from one station of the multi-station casting processing system 20 to another for treatment.

The casting 10 then can be transferred into the furnace 34 from the load station 28. The present invention also encompasses systems in which the casting 10 is transferred directly from the casting machine 22 into the mobile furnace 34. In the embodiment shown in FIGS. 1 and 2, the mobile furnace 34 is a drop-bottom furnace mounted on a furnace gantry 36 that moves from one station to another of the multi-station casting processing system 20. The furnace gantry 36 is aligned on a furnace track 37 that runs between at least two of the stations. The furnace gantry track 37 is positioned on the floor adjacent the various stations of the multi-station casting processing system 20. However, the present invention also encompasses mobile furnaces that are suspended from by a gantry system that is at least partially suspended above or adjacent to the stations. Furthermore, the mobile furnace 34 may be moved on a gantry or similar apparatus that itself does not change position but rather rotates in order to move the furnace 34 from one station to the next.

The castings 10 are moved into the mobile furnace 34 using a transfer mechanism 38. As shown in FIG. 1, the transfer mechanism 38 may be a hoist that is mounted or otherwise operably connected to the furnace 34 and a portion of which extends through one of the walls 40 of the furnace 34 into the interior thereof. Alternative transfer mechanisms are encompassed by the present system. For example, the transfer mechanism may include a robotic arm, elevator or similar device, any of which can be mounted to, inside or adjacent to the furnace 34 in order to transfer one or more castings 10 into or out of the mobile furnace 34. As shown in FIG. 1, the casting support 27 is raised into the furnace 34 using the hoist 38. The casting 10 is supported on the casting support and is positioned so as to be enclosed in the furnace.

A door 44 is movably aligned to close an opening 43 in the furnace 34 through which the casting 10 can be transferred. Although the door 44 and opening 43 are aligned on the bottom wall of the furnace 34 in FIG. 1, the system can also include alternative configurations of the furnace wherein the door 44 is positioned on a side or top of the furnace 34. The door 44 is opened and closed using a door pivot mechanism 46 with which the door 44 may be slid, rotated, swung or otherwise positioned to close the furnace 34. FIG. 1 shows a position of the door 44 when the furnace 34 is open. In one embodiment, the interior of the furnace 34 is approximately 3' wide, 5' long and 5' high. Alternative sizes also are encompassed. Airflow into the interior of the furnace is optional, since, in some cases, heat transfer to the casting 10 is not accomplished within the furnace 34. The temperature of the casting 10 can be controlled in the furnace by either supplying heat to the casting or preventing heat loss from the casting using a radiant, convective or conductive heating element. As shown in FIG. 1, the heating element 42 includes one or more electric heaters mounted on the walls 40 of the furnace that supplies heat to the interior of the furnace 34 and any castings 10 that are disposed therein. In one embodiment, the heating element 42 includes electric rod-over-bend elements located on all four walls of the furnace. Heating baffles 43 are provided to efficiently distribute the heat supplied by the heating element 42 to the casting 10. When a heating baffle 43 is used a fan is not required. The temperature of the casting 10 can be maintained within the furnace 34 so as to avoid or reduce the extent of a drop in the temperature of the casting 10. Once a casting 10 is positioned within the furnace 34, the furnace 34 then is moved to the next station at which the casting 10 is to be treated.

The furnace 34 is moved into position adjacent to the first fluidized bed chamber 51*a* of fluidized bed 50. The fluidized bed 50 can be a deep fluidized bed having one or more independent chambers, each with individual heaters and fluidizers. The fluidized bed 50 shown in FIG. 1 includes first, second, third and fourth fluidized bed chambers 51*a*, 51*b*, 51*c* and 51*d*, respectively. Each chamber includes a fluidized bed lid 54*a*, 54*b*, 54*c* and 54*c*, respectively, to which is attached a lid casting support 56*a*, 56*b*, 56*c* and 56*d*, respectively, and a lid hook 58*a*, 58*b*, 58*c* and 58*d*, respectively. Each fluidized bed lid 54 may be insulated and include, instead of a hook, a loop, ring, catch or other means by which the lid may be engaged and moved. Furthermore, each lid 54 may be identical or substantially similar to the casting support 27, so that each lid 54 and support 27 may be interchangeably utilized at the various stations of the system 100.

The fluidized bed chambers 51*a*, 51*b*, 51*c* and 51*d* can be maintained with either identical or dissimilar temperatures and flow characteristics. Therefore, in the case where the fluidized bed chambers are all maintained at the same temperature, a casting 10 can be placed in only one of the chambers for heat treatment and then moved out of the fluidized bed 50 and to the next station, such as the quench tank 60. In this case, the mobile furnace 34 alternates between chambers 51*a*, 51*b*, 51*c* and 51*d* when castings 10 are loaded in the fluidized bed 50. In one embodiment, when the bed 50 includes four chambers 51, one rack of castings 10 can be loaded and one quenched about every 15 minutes. In a system in which a casting 10 is subjected to multiple heat treatment or other process steps in multiple fluidized beds, or other types of stations, the temperatures of each of chambers 51*a*, 51*b*, 51*c* and 51*d* are different from the others and a casting 10 is moved sequentially from one chamber to another using the furnace 34.

When a casting 10 is to be processed in the fluidized bed 50, the mobile furnace 34 containing the casting 10 is moved into positioned adjacent to the chamber of the bed 50 into which the casting 10 is to be inserted. The door 44 is opened and the transfer mechanism 38 transfers the casting 10 and casting support 27 or lid 54 out of the furnace 34. The casting 10 is then deposited in the chamber 51 as the upper portion of the casting support 27 or lid 54 engages the walls 52 of the bed 50 so as to close the chamber 51. The casting 10 is processed within the chamber 51 and then removed from the chamber in a similar fashion. In one embodiment, sand or other core material is removed from the casting 10 in the fluidized bed 50. For example, in one particular embodiment, approximately 42 lbs of sand is removed in the bed 50 from each casting 10. When fourteen castings 10 are processed per hour, approximately 588 lbs of sand or other core material is removed from the castings 10. After a casting 10 has been deposited in a chamber 51, the mobile furnace 34 may be moved to other stations to remove and deposit other castings in other stations. When a chamber 51 does not contain a casting 10, the chamber 51 may be either open or have a temporary lid placed thereon, which is removed prior to a casting being deposited in the chamber 51. The temperature and flow within a chamber 51 can be controlled so that it is lowered or otherwise maintained when the chamber is open. For example, the supply of heat to a chamber 51 can be stopped when the chamber is open.

The system 100 also may include a quench tank 60. The quench tank 60 contains an appropriate fluid, such as air or water, to quench castings 10 therein. Once a casting 10 has been treated in one of the chambers 51 of the fluidized bed 50, the mobile furnace 34 is positioned over the chamber and the hoist 38 is lowered to engage hook 58 the lid 54 of that particular chamber. The lid 54 is then raised into the furnace 34 and the door 44 is closed. The casting 10 is supported on the lid casting support 56. The mobile furnace is then moved on a furnace gantry track 37 to be aligned with the quench tank 60. The door 44 then is opened and the hoist 38 lowers the lid 54, casting support 56 and casting 10 into the quench tank 60, wherein the temperature of the casting is adjusted or maintained. In one embodiment, the quench tank 60 is approximately 5 feet long, 4 feet wide and 4 feet deep. The quench tank 60 includes a propeller agitator 61 and a submersible tank heater 61*a*. The quench tank 60 may also include a filtration system such as a cyclone type filter that removes sand from the quenchant.

Once the casting 10 has been processed in the quench tank 60, it can then be removed from the quench tank 60 using the quench tank transfer mechanism or gantry 62. The gantry 62 can include an electric hoist 63 for raising the lid 54, casting support 56 and casting 10 from the quench tank 60. The gantry 62 also includes a boom 64 that can be pivoted into position over the quench tank and moved into position over the unloading station 65 that is positioned along a return track 64 and includes a basket, cart, truck or similar device 67 for moving the casting 10 along the return track 64. The casting 10 then is moved to the unload position 66 and transfer from the unload position 66 using an unloading mechanism or gantry 68. The casting 10 can be returned to the thermal arrest unit 30 or other area for further processing. The casting support 27 or lid 54 can then be moved to the casting machine 22 by loader 32 for further additional cycles.

It will be understood by those skilled in the art that while the present invention has been discussed above with reference to certain embodiments, various additions, modifications and changes can be made thereto without departing from the spirit and scope of the invention as set forth in the following claims.

What is claimed is:

1. A casting system comprising:

a multi-station casting processing system, comprising a first station and a second station, wherein at least one of said first and said second stations comprises a fluidized bed; and, a mobile furnace comprising a heating element, wherein said mobile furnace is movable between said first station and said second station.

2. The system of claim 1, wherein said mobile furnace further comprises a door.

3. The system of claim 1, wherein said multi-station casting processing system comprises a pouring station at which molten metal is poured into molds to form castings.

4. The system of claim 3, wherein said multi-system casting processing system further comprises a casting retractor for removing castings from said pouring station.

5. The system of claim 1, wherein said heating element comprises a radiant heating element.

6. The system of claim 1, wherein said fluidized bed has a series of individual fluidized bed chambers.

7. The system of claim 6, wherein each of said fluidized bed chambers is heated independently.

8. The system of claim 1, wherein said fluidized bed chambers each include a removable lid.

9. The system of claim 8, wherein each of said removable lids includes a casting support.

10. The system of claim 1, wherein said mobile furnace is a drop bottom furnace.

11. The system of claim 1, wherein said multi-station casting processing system further comprises a thermal arresting unit.

12. The system of claim 11, wherein said thermal arresting unit includes a radiant heating element.

13. The system of claim 1, wherein said multi-station casting processing system comprises a quench tank.

14. The system of claim 1 and further comprising a transfer mechanism capable of transferring a casting between said mobile furnace and said first station.

15. The system of claim 14, wherein said transfer mechanism comprises a hoist operably connected to said mobile furnace.

16. A system for producing and processing metal castings, comprising:

a casting station;

a heat treatment station; and a mobile furnace having a heating element for maintaining the castings within a desired range of temperatures, said mobile furnace being movable along a path from said casting station to said heat treatment station, whereby the mobile furnace the castings between said casting station and said heat treatment station.

17. The system of claim 16, wherein said heating element of said mobile furnace is capable of producing radiant heat.

18. The system of claim 16, wherein said heat treatment station comprises a multi-chambered fluidized bed.

19. The system of claim 18, wherein each of said fluidized bed chambers includes a removable lid.

20. The system of claim 19, wherein each of said lids includes a casting support connected thereto and a hook for engagement and conveyance of the castings on said casting supports into said mobile furnace.

21. The system of claim 16, wherein said casting station includes a tilt pour machine for pouring a molten metal into molds to form the castings.

22. The system of claim 16, wherein said casting station further comprises a casting retractor for removing the castings from their molds.

23. The system of claim 16, and further comprising a quench tank, wherein said mobile furnace is movable between said heat treatment station and said quench tank.

24. The system of claim 23 and further comprising a quench tank casting transfer mechanism.

25. The system of claim 16, wherein said casting station comprises a thermal arresting unit having a heating element for maintaining the castings within a desired range of temperatures prior to transport to said heat treatment station.

26. The system of claim 16, further comprising a transfer mechanism capable of transferring a casting from said mobile furnace to said heat treatment station.

27. The system of claim 26, wherein said transfer mechanism comprises a hoist operably connected to said mobile furnace.

28. A casting system comprising:

a casting machine;

a thermal arrest unit;

a multi-chamber fluidized bed; and a mobile furnace comprising a heating element, wherein said mobile furnace is movable between said thermal arrest unit and each chamber of said multi-chamber fluidized bed.

29. The casting system of claim 28 and further comprising a casting transfer mechanism operably connected to said mobile furnace.

30. The casting system of claim 28, wherein each chamber of said multi-chamber fluidized bed comprises a removable lid having a casting support attached thereto.

31. The casting system of claim 28, further comprising a quench tank, wherein said mobile furnace is movable between said multi-chamber fluidized bed and said quench tank.

32. A method of producing metal castings comprising:

pouring a molten metal material into molds at a casting station to form the castings;

transferring the castings to a mobile furnace;

moving the mobile furnace and depositing the castings in a chamber of a heat treatment station; and removing the castings from the heat treatment chamber to the mobile furnace after completion of heat treatment.

33. The method of claim 32, further comprising exposing the castings to a fluidized bed within the chamber of the heat treatment station.

34. The method of claim 32, further comprising applying heat to the castings while inside the mobile furnace.

35. The method of claim 32 and wherein depositing the castings in a chamber comprises moving the mobile furnace from the casting station to one of a series of fluidized bed chambers of the heat treatment station.

36. The method of claim 35, wherein depositing the castings in a chamber further comprises lowering a lid from which the casting is suspended onto the heat treatment station.

37. The method of claim 32, further comprising transferring the castings to a thermal arrest unit.

38. The method of claim 32, further comprising quenching the castings.

39. The method of claim 32, further comprising:

heat treating the castings in a fluidized bed chamber within the heat treatment station;

transferring the castings from the fluidized bed chamber to the mobile furnace;

moving the mobile furnace; and transferring the castings from the mobile furnace to a second heat treatment station.

40. The method of claim 39, further comprising exposing the castings to a second fluidized bed within the second heat treatment station.

41. A method of processing a casting comprising:

transferring a casting into a mobile furnace;

moving the mobile furnace to a first position;

transferring the casting from the furnace to a processing station;

processing the casting within the processing station, wherein processing the casting within the processing station comprises exposing the casting to a fluidized bed;

transferring the casting from the processing station back to the mobile furnace;

moving the mobile furnace to a second position; and removing the casting from the mobile furnace.

42. The method of claim 41, further comprising exposing the casting to radiant heat within the mobile furnace.

43. The method of claim 41, wherein transferring the casting from the mobile furnace to the processing station comprises lowering the casting from the mobile furnace into an individual chamber of the processing station.

44. The method of claim 41, further comprising transferring the casting from the mobile furnace to a quench tank.

* * * * *